United States Patent [19]

Clegg

[11] 4,149,355

[45] Apr. 17, 1979

[54] PACKAGING METHOD AND APPARATUS

[75] Inventor: Frederick W. Clegg, Wansford, England

[73] Assignee: Dufaylite Developments Limited, Cambridgeshire, England

[21] Appl. No.: 813,557

[22] Filed: Jul. 7, 1977

[30] Foreign Application Priority Data

Jul. 9, 1976 [GB] United Kingdom ..... 28641/76
Dec. 3, 1976 [GB] United Kingdom ..... 50455/76

[51] Int. Cl.[2] ..... B65B 5/08; B65B 5/10; B65B 35/30

[52] U.S. Cl. ..... 53/448; 53/475; 53/154; 53/534; 53/240; 53/246

[58] Field of Search ..... 53/26, 35, 254, 160, 53/166, 238, 240, 246

[56] References Cited

U.S. PATENT DOCUMENTS

| | | | |
|---|---|---|---|
| 2,573,100 | 10/1951 | Haecks | 53/246 X |
| 2,833,095 | 5/1958 | Stuart | 53/246 X |
| 2,847,809 | 8/1958 | Lindeman et al. | 53/160 |
| 3,389,531 | 6/1968 | Ehe et al. | 53/160 X |
| 3,735,552 | 5/1973 | Derderian | 53/160 X |
| 4,044,527 | 8/1977 | Ulrich et al. | 53/76 X |

FOREIGN PATENT DOCUMENTS

| | | | |
|---|---|---|---|
| 2200947 | 7/1973 | Fed. Rep. of Germany | 53/240 |

*Primary Examiner*—Robert Louis Spruill
*Attorney, Agent, or Firm*—William Anthony Drucker

[57] ABSTRACT

Apparatus is provided for packing articles, for example apples and other readily damaged fruits, in a close-packed array. A first feeder operates to pack a first supply of the articles in spaced-apart groups and a second feeder operates to fill the spaces between these groups. The feeders are preferably rotary members rotating in a vertical plane and having circumferential depressions. These depressions cooperate with peripheral confining barriers, eg. belts, to carry the articles downwardly and release them as required. The packages for receiving the articles, preferably pieces of expanded structural honeycomb material, may be carried under the feeders by a movable, synchronized conveyor. This conveyor may have protruberances for holding the honeycomb material expanded during filling. Unloading may be effected by raising the filled package into a confining frame in which it is then moved for deposition in a carton.

4 Claims, 18 Drawing Figures

Figure 1:
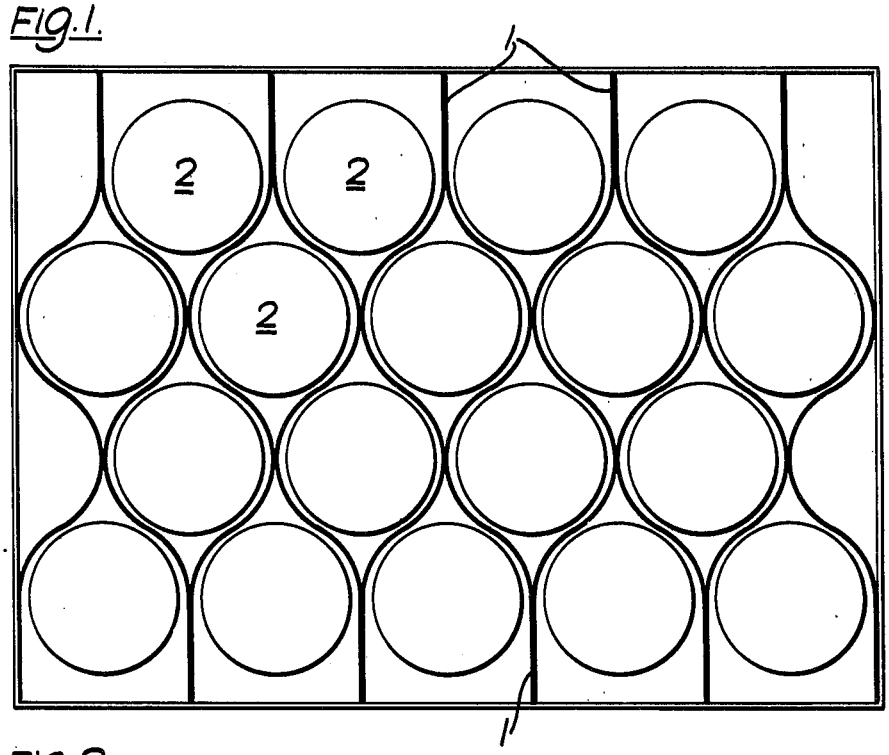

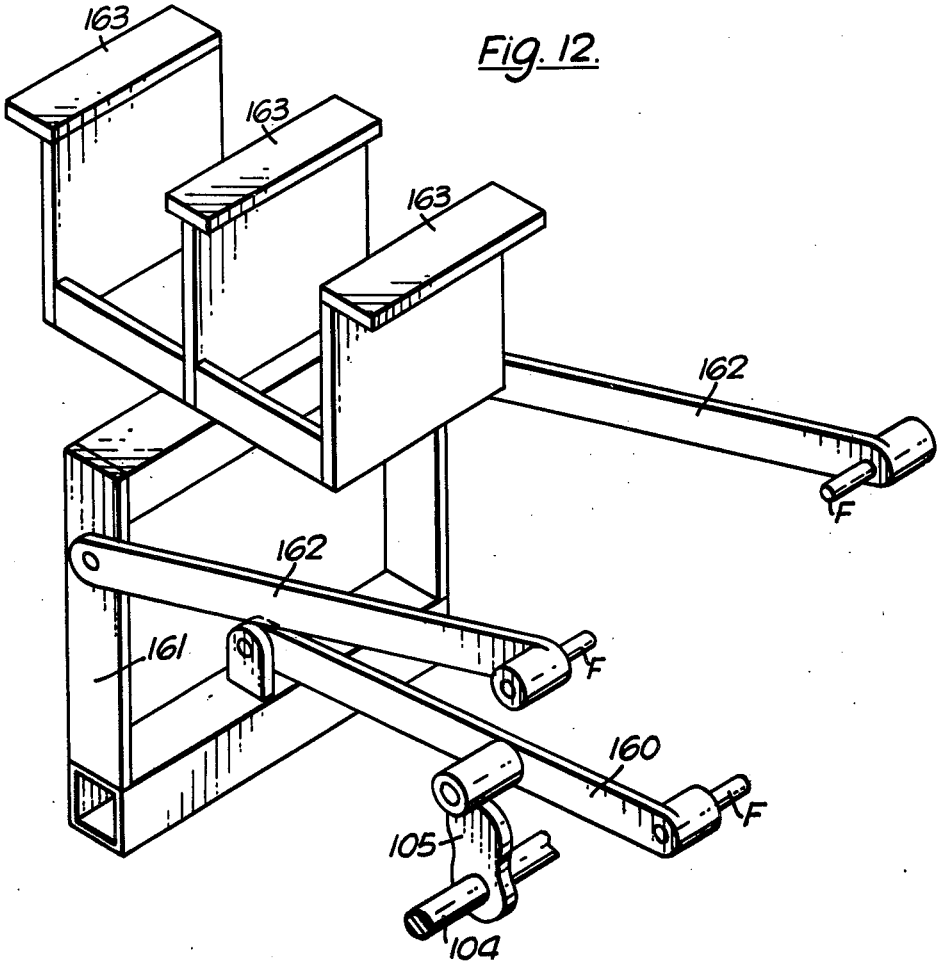
Fig. 12.
Fig. 14.
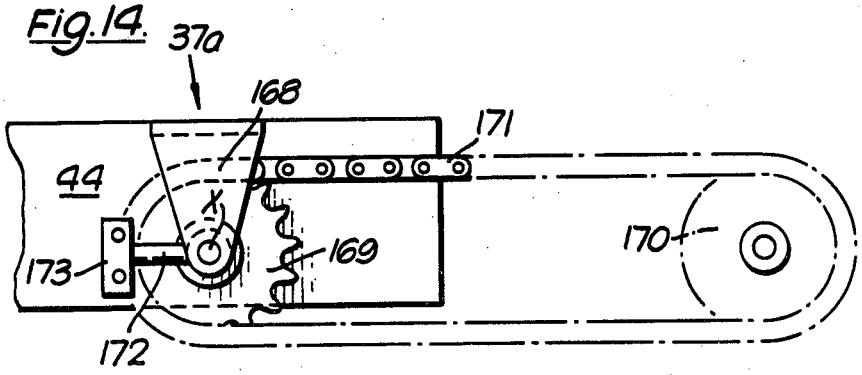

PACKAGING METHOD AND APPARATUS

SPECIFICATION OF THE INVENTION

The present invention relates to packaging apparatus and has as an object the provision of such apparatus in an automated form.

In accordance with the present invention, there is provided an apparatus for arranging articles in an array, which apparatus comprises a distributor operable to form part of the array by positioning some of the articles in a set of spaced-apart groups of the articles and subsequently positioning others of the articles in other spaced-apart groups thereby filling the spacings between the spaced-apart groups of said set to complete the array.

By operating in two stages, first positioning one set of groups and then filling the spaces between them, the apparatus is able to pack articles, eg. apples and other kinds of fruit, which are readily damaged by placing them in, or very close to, their required positions in the array and avoiding movement of the articles in contact with one another. The spacing made available between the groups serves to accommodate the handling mechanism for the articles.

For the packaging of fruit in or on a divider, e.g. a moulded tray of cellulosic or resinous material or an expanded structural honeycomb material (described in British Patent Specification No. 591,772 and elsewhere) formed of paper or cardboard, it is usual to arrange the individual fruits in a regular close-packed array, i.e. an array in which they are arranged in straight rows with the fruits of one row being staggered with respect to the fruits of the next so that the rows are in a mutually penetrating relationship. Prior packaging apparatus has usually tumbled the fruit over the divider until the individual items have settled in the required positions, but this undesirable step is avoidable by the present invention.

The distributor conveniently has a first feeder arranged to position the articles in the set of spaced-apart groups and at least one other feeder arranged to position the other articles in their groups.

In a preferred form of the apparatus, the feeders are rotary feeders having surface formations each for locating a single article. Suitably, the rotary feeders are rotatable about horizontal axes and have retaining devices for retaining the articles relative to the feeders as the articles are carried downwardly and releasing them substantially at the lowermost position of their rotational loci. The retaining devices may be components shaped to provide fixed confining walls but, to save rubbing of the articles in confining them, the retaining devices are preferably driven belts.

The rotary feeders can be arranged for continuous operation by providing a feed of the articles in a position where the surface formations have been emptied, e.g. from one or more chutes.

According to a preferred arrangement, the feeders are spaced apart along a conveyor adapted to convey a receiver for the array for the positioning the articles in the first set of spaced-apart groups (eg. by a first feeder as aforesaid) and then for the positioning of the second set of groups (e.g. by a second feeder.) The motion of the receiver is preferably continuous during the positioning of the first and second spaced-apart groups. The continuous motion may be a part or parts of a step-wise motion of the conveyor, providing periods when the conveyor is stationary, which periods facilitate loading the conveyor with the empty receivers and unloading the receivers after filling.

A convenient form of rotary feeder has groups of the surface formations, each of which groups is distributed to position a spaced apart group of the articles. For groups in the form of straight rows in the array, each group of surface formations may extend diammetrically around its feeder, though groups extending helically may be preferred for some purposes.

Where the groups of surface formations extend around the feeders, some at least of the groups may extend incompletely around their feeder. This arrangement is adopted, for example, for a close-packed array in which the number of articles differs from the odd rows to the even rows. When the arrangement is used with a conveyor, as described above, the phases of the feeders as well as their rotational rates, should be synchronised with the motion of the conveyor.

For use with honeycomb material, the conveyor may be provided with pegs or other attachments for holding the honeycomb in the expanded condition while it is being filled with the array. After filling, the articles retain the material expanded.

The conveyor may be unloaded in any convenient manner at an unloading station on the apparatus. Usually the dividers bearing the arrays are required to be stacked in containers. Honeycomb material has cells open at the underside as well as the top and for convenience at the unloading station each expanded slice may be positioned upon a layer pad rather than directly upon the conveyor.

A preferred form of the apparatus for filling the cells of packaging units formed of expanded honeycomb material, comprises a conveyor, preferably of the endless-belt type, movable through a packaging unit receiving station and an unloading station, loading means between the receiving station and the unloading station for loading articles to the cells of the packaging units to form loaded units, advancing means for advancing the conveyor stepwise so that the conveyor is halted for receiving the packaging units at the receiving station and is stationary each time a loaded unit reaches the unloading station, and unloading means at the unloading station for unloading the loaded units from the conveyor while confining them to retain the loaded articles in position.

The stepwise advancement of the conveyor is advantageous for two principal reasons. Honeycomb material is most conveniently supplied in the closed cellular state and indeed tends, when free, to return to this state. The expansion and application of honeycomb to the conveyor by automatic apparatus is greatly simplified by having the conveyor temporarily stopped at the receiving station. Secondly, a layer of articles packaged in a piece of expanded honeycomb is not self-stable. It requires a layer-pad to provide a bottom closure for the cells and, as some of the cells are open to the side, it also requires confining laterally until fitted within a box for transport. An important property of honeycomb material is its compressive strength which enables several layers of the contained product to be stacked in a single box. Having the conveyor stopped temporarily at the unloading station greatly simplifies the provision of automatic apparatus for removing the loaded units.

In a preferred arrangement, the conveyor is of skeletal or other perforate structure (preferably provided by spaced-apart transverse slats) and the unloading means includes at least one lifting member arranged to lift the loaded units when the conveyor is stationary and retract through the conveyor to permit the advancement thereof. Having transverse slats is advantageous also in that the slats may be employed to carry pegs or other attachments for holding the honeycomb. Indeed, the attachments may be slidably adjustable along the slats to facilitate a change in the cell dimensions of the honeycomb employed.

The loading means is preferably a two stage drum device as hereinbefore described. Other forms of loading means may be employed, eg. when the product to be packaged is undamaged by rough handling. Mechanical synchronization of the loading means with the stepwise-moving conveyor is readily achieved.

Figure 2:
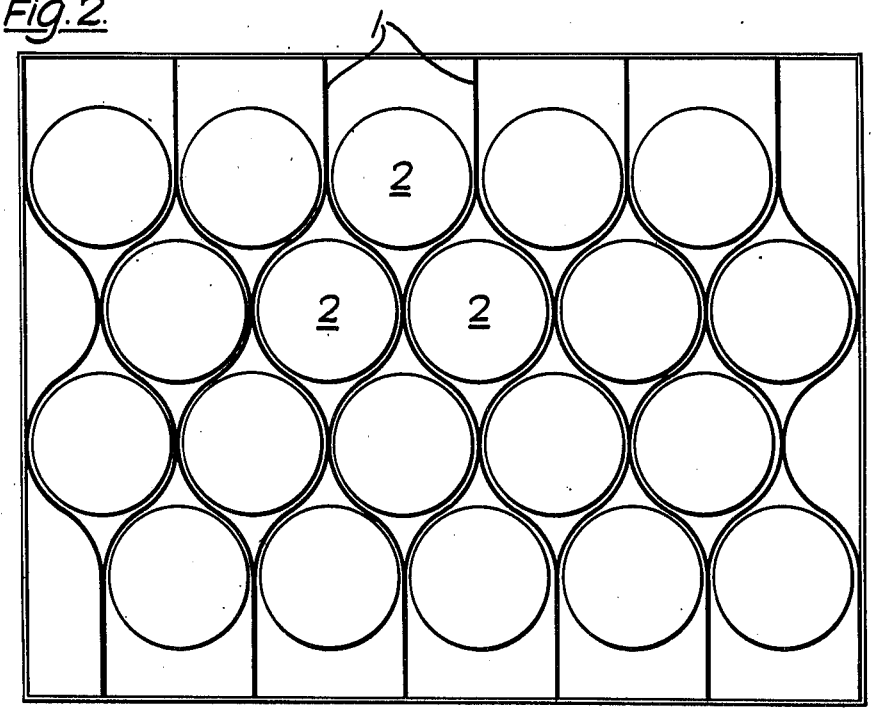
Figure 3:
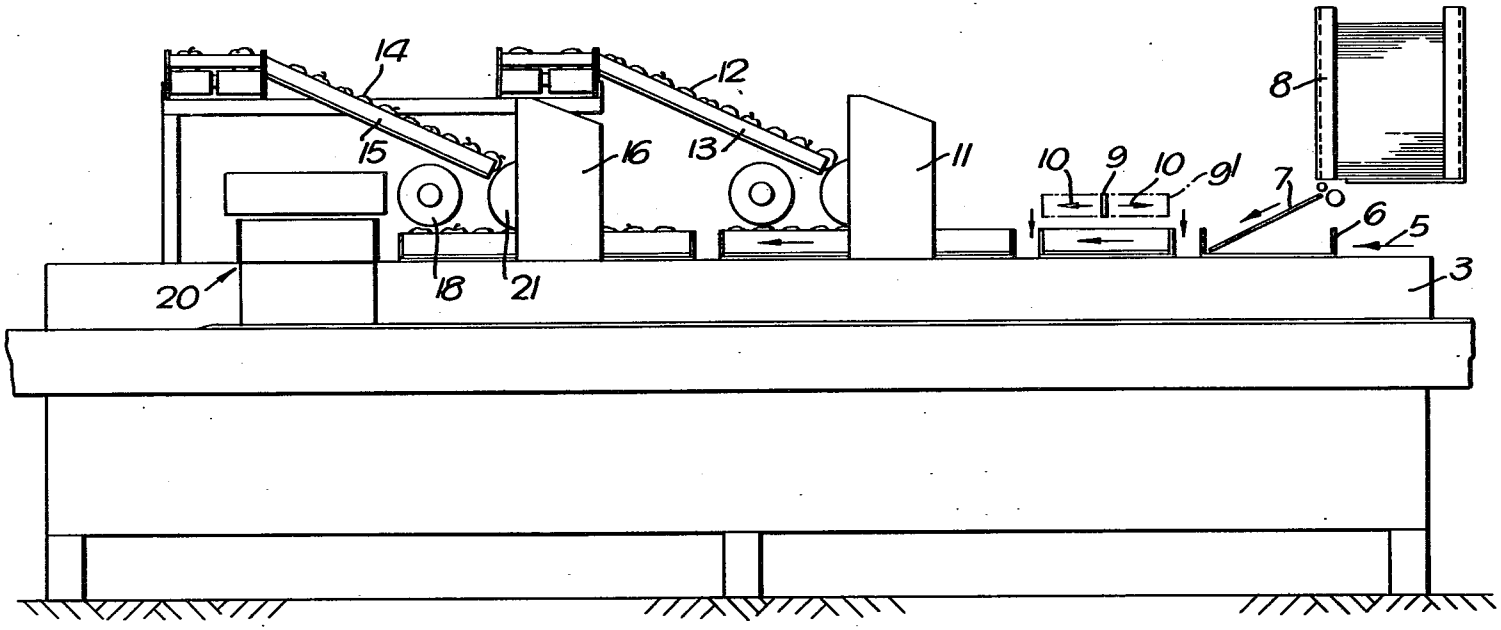
Figure 4:
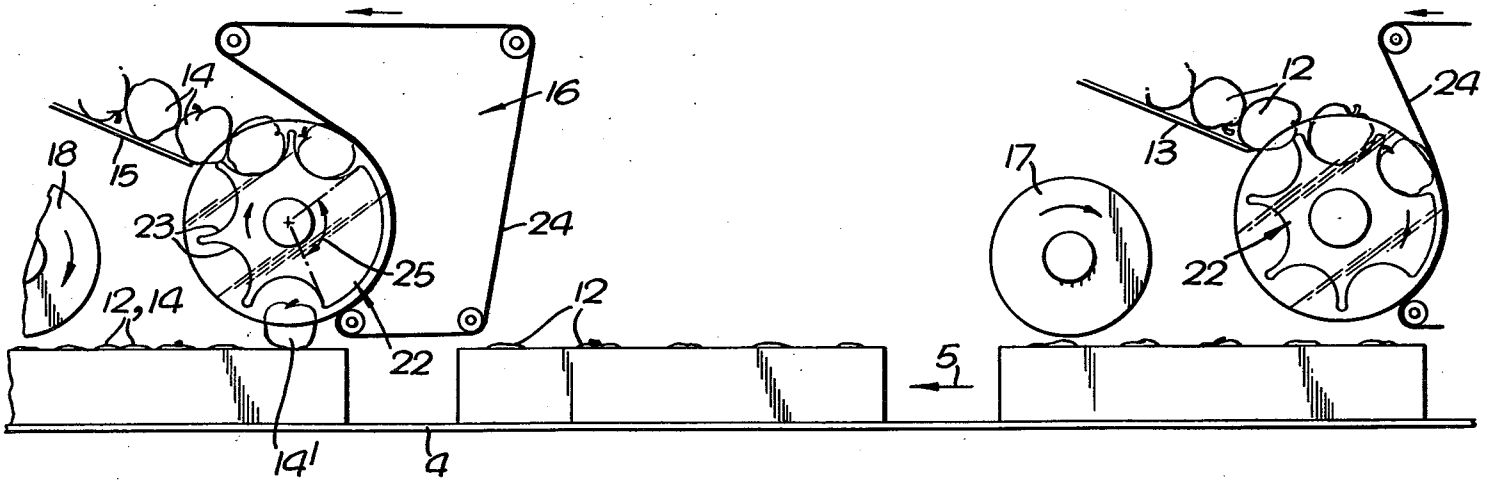
Figure 5:
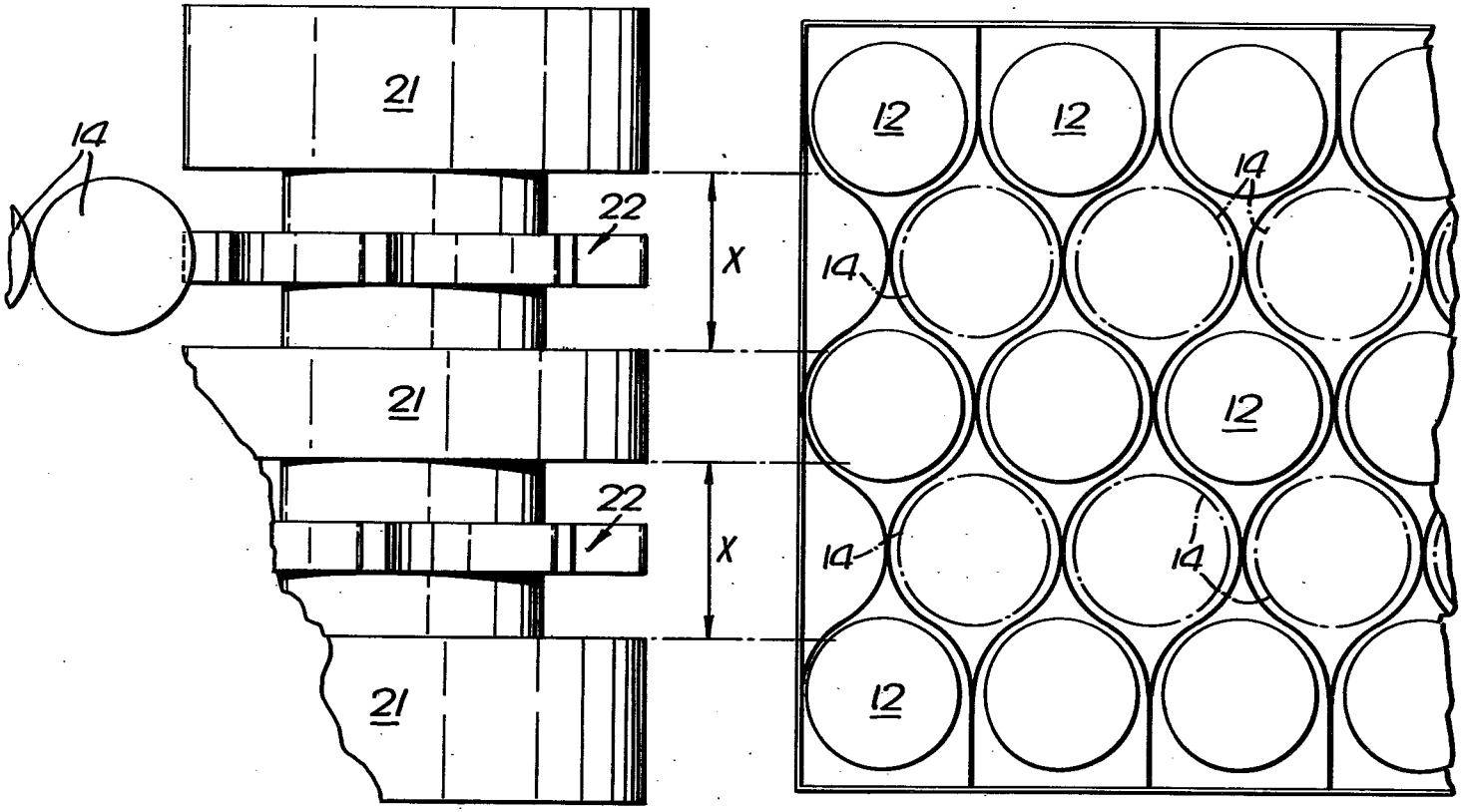
Figure 6:
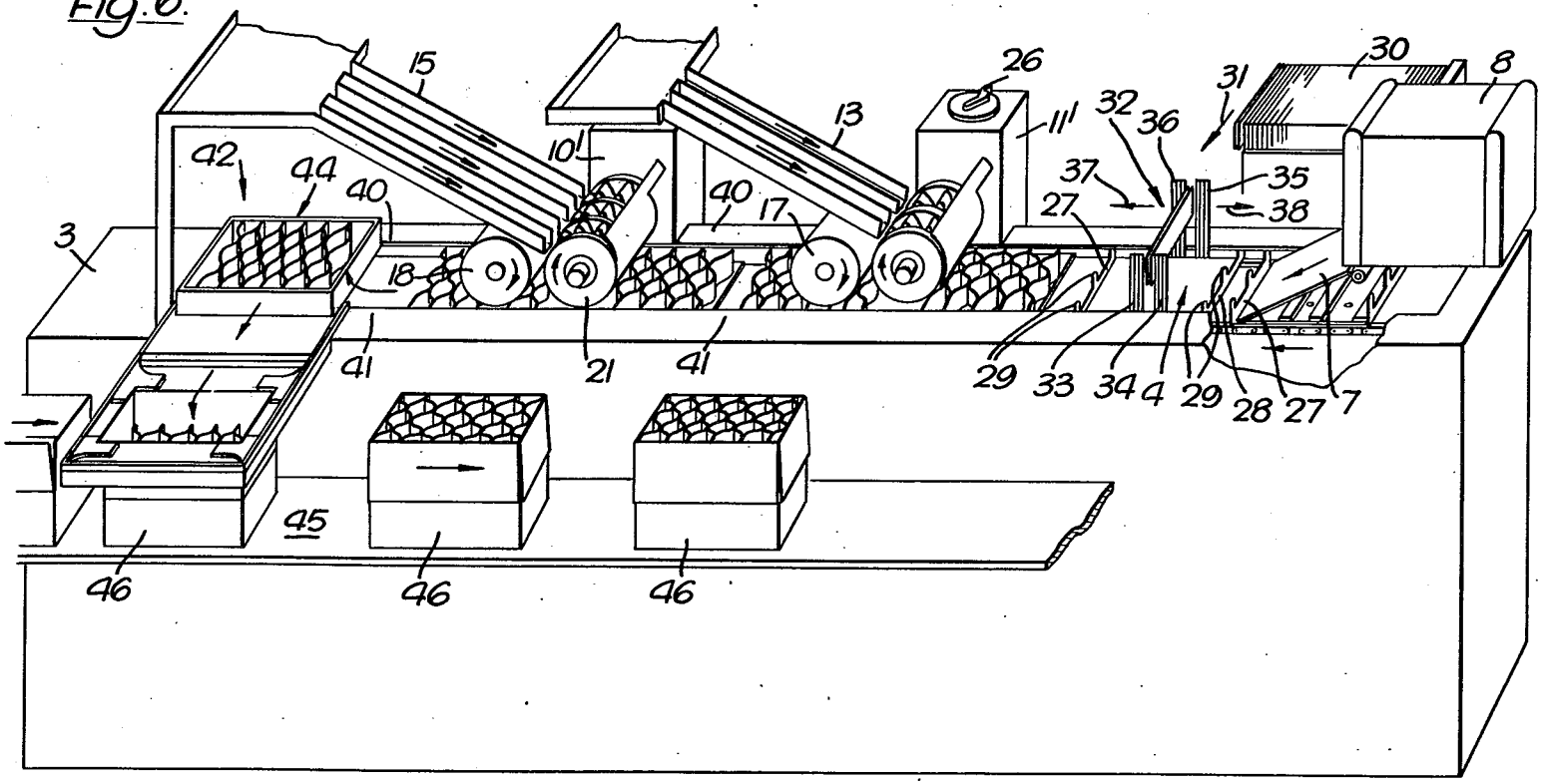

The following description in which reference is made to the accompanying drawings is given in order to illustrate the invention. In the drawings:

FIGS. 1 and 2 diagramatically illustrate arrays of apples packaged in expanded slices of honeycomb material, FIG. 3 shows in elevation, a first embodiment of a packaging apparatus according to the invention, FIG. 4 is an elevation showing details of the feeders in the apparatus of FIG. 3, FIG. 5 shows one of the feeders and its operation in plan, FIG. 6 shows a second embodiment in perspective, FIGS. 7 to 11 show details of the conveyor and the honeycomb expanding and applying mechanism of the apparatus of FIG. 6, and FIGS. 12 to 18 show details of the unloading mechanism of the apparatus of FIG. 6.

In certain of the Figs. connection of parts with a main stationary machine frame is indicated at F.

FIG. 1 shows an expanded slice of honeycomb material 1 expanded to form cells for receiving an array of apples 2. The array has two rows of four apples and two rows of five apples. FIG. 2 shows a similar arrangement but with 4 rows of 5. It will be noted that the apples are staggered, in both cases, from one row to the next. FIGS. 1 & 2 are given merely in order to illustrate how apples have to distributed to fill the cells of honeycomb material.

FIG. 3 shows an example of an apparatus according to the invention. Casing 3 contains a conveyor belt 4 (FIG. 4) moving in the direction of arrow 5. The belt has formations for the regularly spaced location of trays 6. The bottom of each tray is fitted with a cardboard layer pad 7 from a magazine 8 and then with a slice of honeycomb 9 expanded in the directions of arrows 10 to an open cellular configuration shown in dash-dot lines at 9'.

The expanded slices are carried through a first feeder unit 11 fed with apples 12 descending a chute 13 which fills alternate rows of cells. Then the partly filled slices are filled with apples 14 descending chute 15 to a second feeder unit 6.

Apples 13 are fed in three rows of six and apples 14 are fed in two rows of five therebetween (FIG. 5). Rollers 17 and 18 press the apples into the honeycomb where necessary. The filled honeycomb is removed at station 20 in any convenient manner.

FIG. 5 shows the package containing three rows as it approaches unit 16. In this unit is a rotor having three cylindrical members 21 and between them two profiled members 22. Its periphery is formed with five deep arcuate depressions 23 which are loaded in turn, each with one apple 14, as they pass chute 15. The apples are carried round, being restrained between cylindrical members 21 and belt 24 driven substantially at the velocity of the outer parts of apples 14. When an apple 14 reaches the bottom of the rotor it falls into the cells of the honeycomb.

As will be seen, a sector 25 of each member 22 is free from depressions 23. The angular size and phase of sectors 25 are such that apples 14 start to be delivered as the beginnings of the rows of empty cells for receiving them come into position and delivery terminates after the fifth apples have been positioned in the rows.

Feeder unit 11 is similar to unit 16 except that its rotor has three profiled members 22' and each member 22' has six arcuate depressions.

It will be noted from FIG. 5 that the distance x available for handling the apples 14 is greater than the spacing between the rows 13 of apples already positioned in the honeycomb.

The rotors of the feeder units are replaceable, and/or alterable by changing the profiled members and, if necessary, cylindrical members 21 for packing arrays of other parameters.

The apparatus of FIG. 6 is a modification of that of FIG. 3. Corresponding parts are given the same reference numerals. Feeder units 11' and 10' differ from those previously described in that the rotary parts are supported at one end of their axes only, as shown, and are adjustable in height above the conveyor belt by rotary handles, eg. handle 26, for different package thicknesses.

Conveyor belt 4 is divided into sections each of which is bounded by a forward transverse slat 27 and a rearward transverse slat 28 between which are two further transverse slats (not shown in FIG. 6). These slats are carried, at their ends, by endless chains driven stepwise. Slats 27 and 28 are provided with slidably adjustable pegs 29.

A magazine 30 holds unexpanded slices of honeycomb material which are delivered one by one in the direction of arrow 31 manually or by a conventional roller drive as required. Each slice is received by an expander device 32 where it is located between two sets of pumped vacuum cups mounted on transverse bars carried by upwardly projecting members 33, 34, 35 and 36. Members 33 and 36 are moved in the direction of arrow 37 and members 34 and 35 are moved in the direction of arrow 38 to expand the honeycomb. The end vacuum cups are free to move to follow the transverse shrinkage of the honeycomb. When the honeycomb is expanded, it is hooked over pegs 29 by downward retraction of the members 34 to 36.

Filling of the expanded pieces of honeycomb takes place as described with reference to FIGS. 3 to 5, the packaged apples or other product being retained in the incomplete cells by the inwardly facing laps of belts at 40 and 41 driven with the conveyor belt 4.

When a filled package reaches the unloading station which is so positioned that it is stopped by the stepwise motion of the conveyor, a cam-actuated elevator topped by lifting pads, is moved upwardly between the slats to engage the layer pad 43 which was laid on the belt before the honeycomb from magazine 8. The package is raised clear of the belts into a confining frame 44, mounted for horizontal movement across the direction of the conveyor. Fngers 174 on the frame assembly are slid between the lifting pads to support the package, and the lifting pads are retractable to permit the conveyor to move in its next step.

A conveyor belt 45 carries cartons 46, dimensioned to fit the filled packages and halts them in turn at the unloading station. By the said movement of the frame assembly, the frame is carried over a waiting carton and the fingers 174 are withdrawn to allow the package to descend. In practice, the resistance of the air in the carton to displacement (it has to flow round the edges of the layer pad) moderates the descent adequately to prevent damage to the packaged product.

Further details of parts of the apparatus are given with reference to FIGS. 7 to 18. In certain of these figures an arrow 37*a* is shown, the horizontal direction of which corresponds with that of arrow 37 of FIG. 6.

Figure 7:
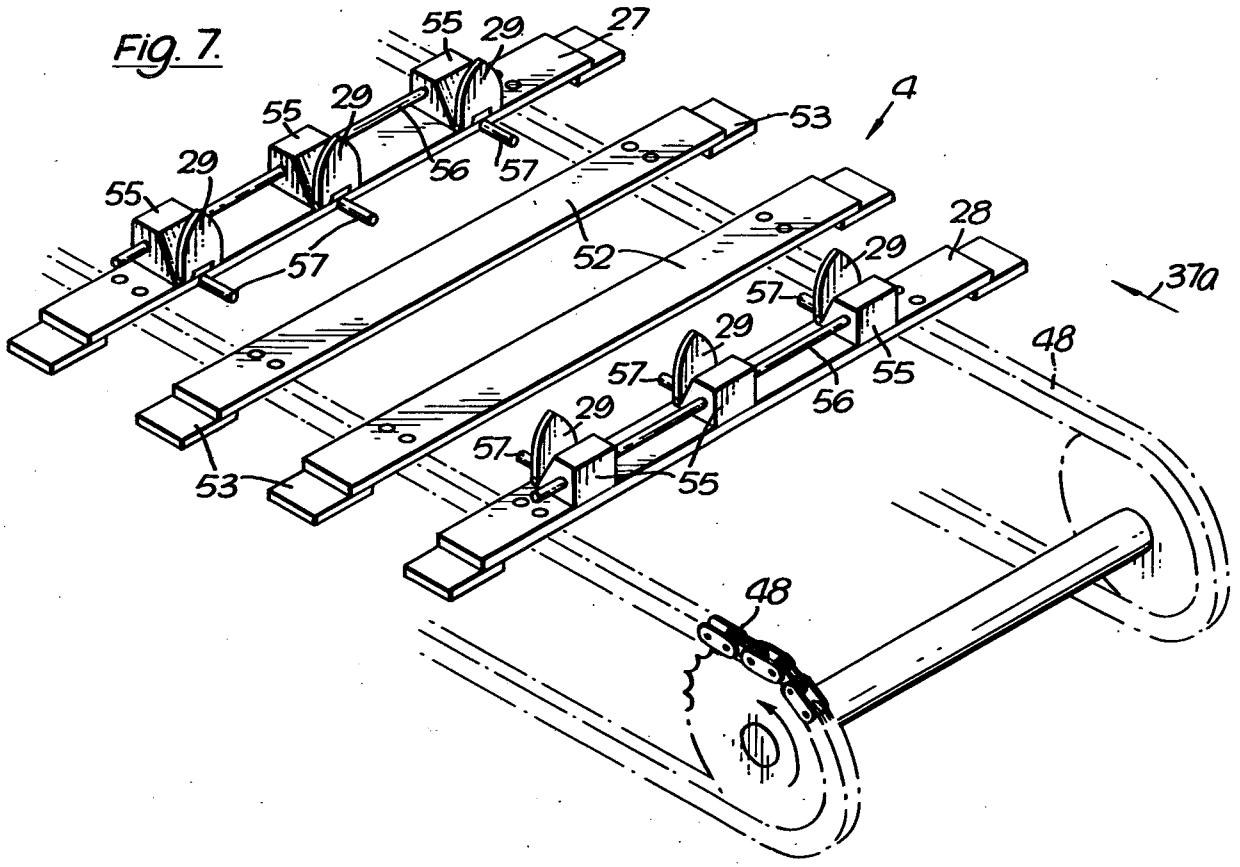

FIG. 7 shows part of the conveyor belt 4. It has two identical chains 48 each supported and driven by two sprocket wheels of which two, viz. one for each belt, are shown. Slats bridge the chains to form the belt. The ends of each slat are equipped with a nylon block 53 which run on fixed guides. A group of four slats form a unit. The two center slats 52 are plain, having a mere supporting function, while the two outer slats 27 and 28 carry pointed pegs 29 for receiving the expanded honeycomb material as aforesaid. The pegs 29 are mounted on blocks 55 which are slidable along the rods 56 mounted over slats 27 and 28 in order to accommodate different sizes of honeycomb. The conveyor moves one pitch at a time and then comes to rest. One pitch is equal to the expanded size of a piece of honeycomb plus the spacing between successive pieces. Small brass pegs 57 are fitted to slats 27 & 28 to support the ends of the layer pads 7.

The construction of a preferred form of expander device, usable at 32 in FIG. 6, is shown in FIGS. 8 to 11.

Figure 8:
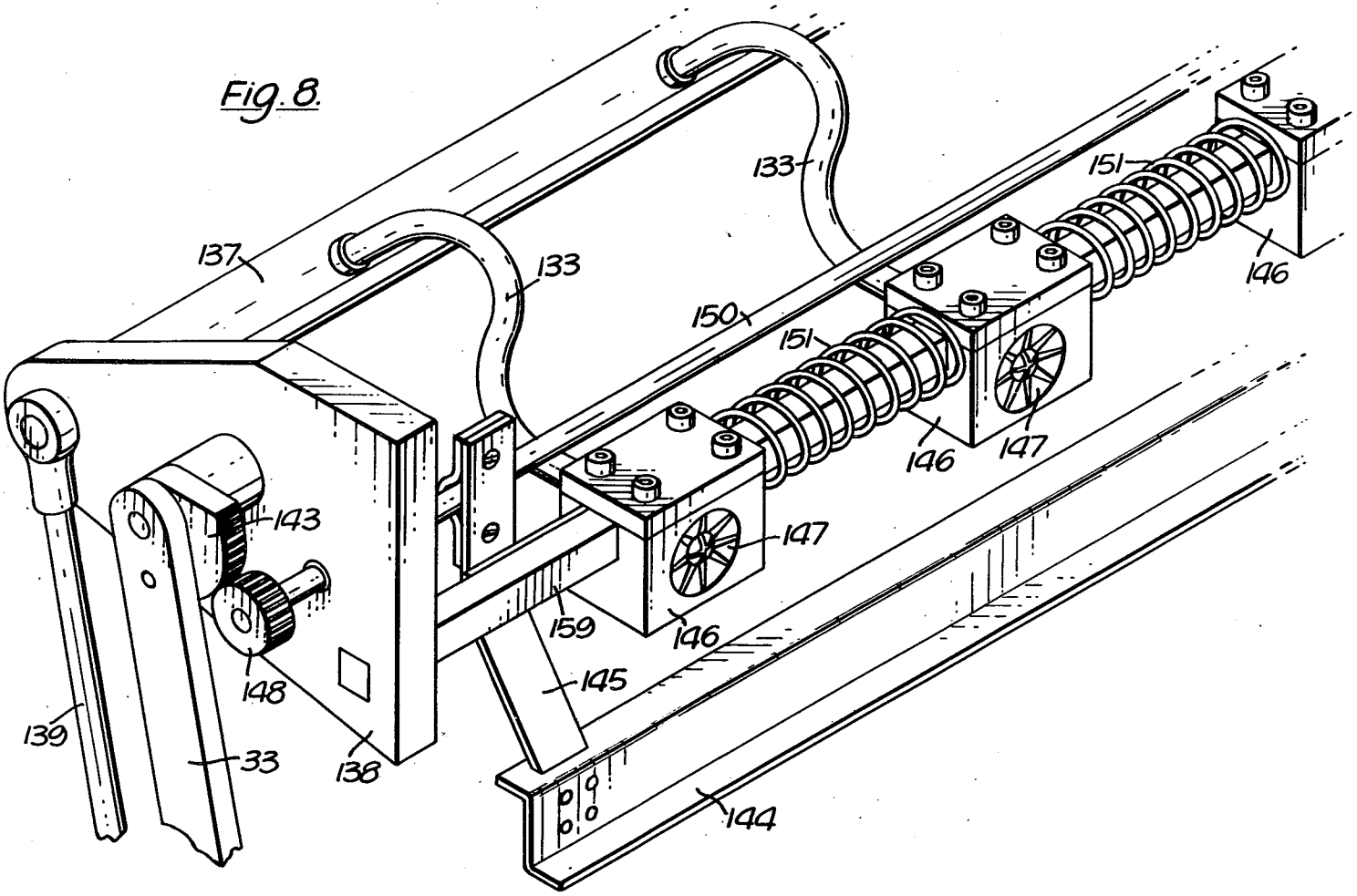
Figure 9:
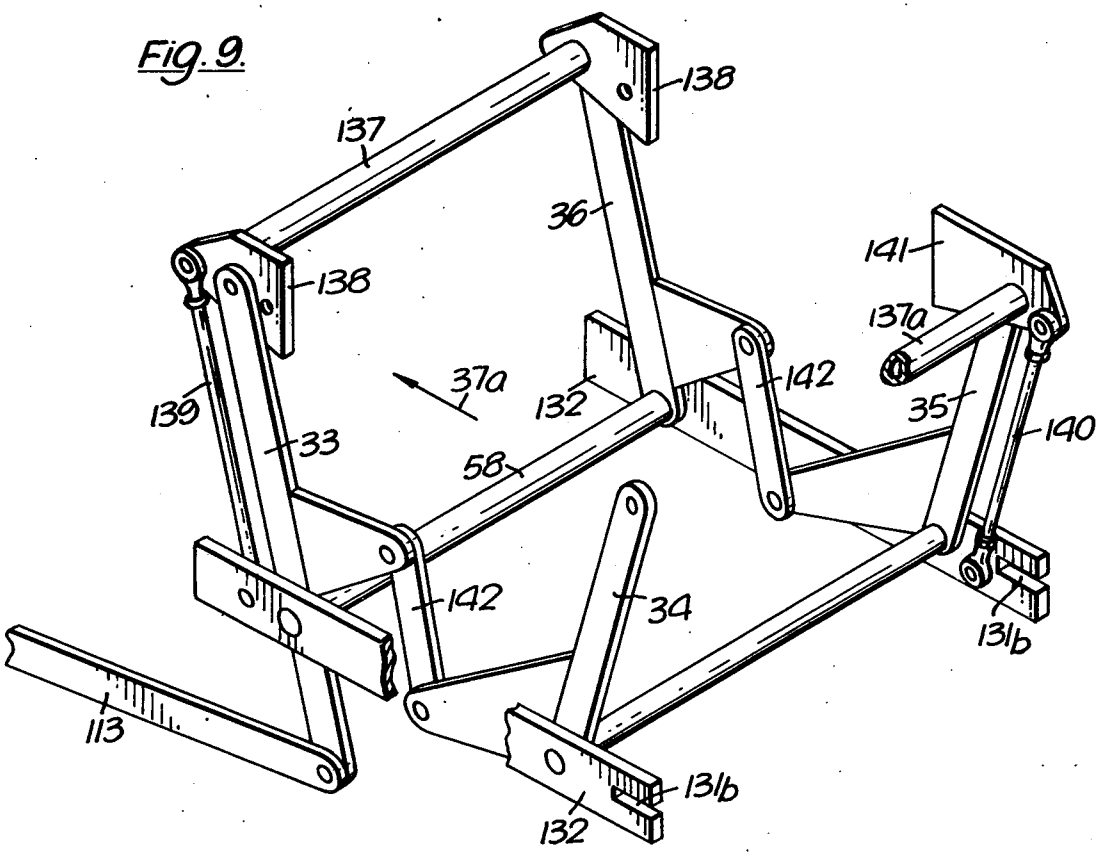

A slice of unexpanded honeycomb is inserted into a horizontal trough constituted by two identical parts of which one, 144 is shown in FIG. 8. A set of three vacuum cups 147 (one set only, shown) carried on blocks 146 is then moved into contact with each face of the slice and a vacuum pump is connected with all six vacuum cups by a valve operated by a cam 109, a follower arm 112, and rod 115 shown in FIG. 11. The cups are then moved apart and lowered so that the divider is expanded and engaged with the pegs 29 on the belt conveyor. A jet of air is directed vertically down on to the slice to ensure that its expansion is begun correctly to assist in opening up the divider.

Figure 11:
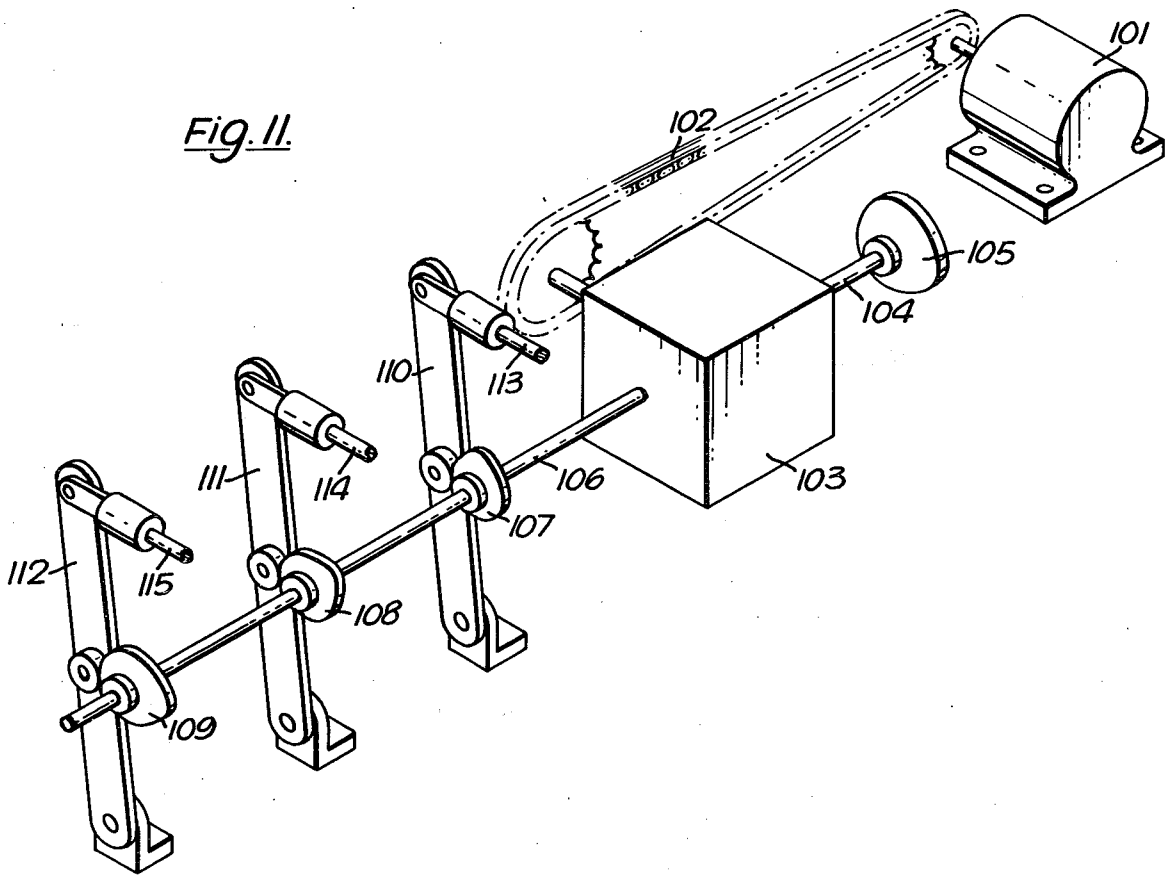

Referring to FIG. 11, an electric motor 101 drives a reduction gearbox 103 through a chain drive 102. A first output shaft 106 of the gearbox carries three cams 107, 108, & 109. A second output shaft 104 carries a cam 105. The cams each cause a separate follower lever to move. Follower arm 111 operated by cam 108, and rod 114 causes a frame which carries the vacuum cup assembly to rise and fall. Follower arm 110 operated by cam 107 causes the two sets of cups to be moved apart.

Figure 10:
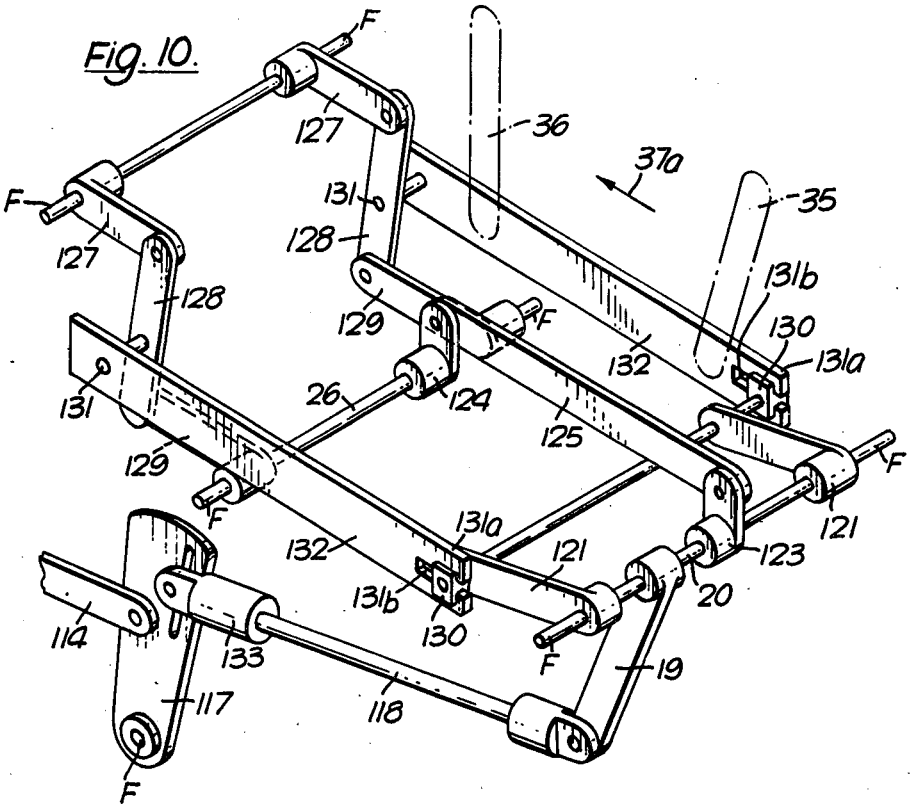
Figure 13:
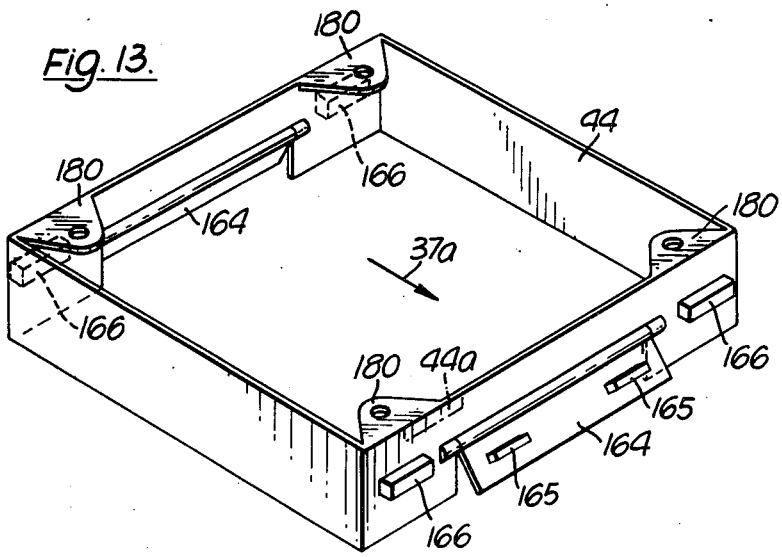

The raising and lowering mechanism for the vacuum cups is shown in FIG. 10. The main side members 132 of a frame are supported at their ends by a set of levers 127, 128 & 129, which form a Watts parallel link motion linkage, by which pivot pins 131 at the center of lever 128 move substantially vertically over the range of movement required. The ends 131*a* of members 132 are supported by phosphor bronze blocks 130, working in slots in 131*b* and carried at the ends of levers 121. Levers 123 & 124 and link 125 ensure that the two ends of members 132 move up and down together. To raise the members 132, lever 117 is pivoted about pivots F by rod 114 causing lever 118 to be pulled. A slot in lever 117 permits the amount of movement to be adjusted. Rod 118 can be screwed into or out of its boss 133 in order to adjust the position of the frame. The opening and closing movement of the vacuum cups originates in cam 107 which moves lever 110 and so pulls rod 113 which is attached to lever 33 (FIG. 6) mounted on member 132. A twin lever 36 moves in unison with the lever 33 because of linking tube 58. The levers 34 & 35 have a mirror image movement with levers 33 & 36 because of their connection with 34 & 35 by generally triangular extension lugs and links 142. The upper ends of levers 33 & 36 carry plates 138 on which are mounted the vacuum cup assemblies (see FIG. 8). Plates 138 & 141 maintain a constant orientation because of parallelogram motions applied by rods 139 & 140. Plates 138 are linked by a tube 137 which also serves as a vacuum manifold for the vacuum cups 147. A similar tube 137*a* links the plates 141 (only one shown in FIG. 9) which carry the other vacuum cup assembly.

The movements given by cams 107 & 108 are timed to provide the two sets of vacuum cups with the correct motions for expanding the honeycomb, lowering it after to expansion to engage the pegs 29, and subsequently ascending and moving together for reception of the next unexpanded slice of honeycomb.

As shown in FIG. 8, the blocks 146 carrying the vacuum cups 147 can be slid along a square shaft 159. The center block is fixed and the outer two are slidable and biassed outwards by coil springs 151 so that they can move to accommodate the transverse contraction of the honeycomb as it is expanded to the open cellular state. A spindle 150 carries brackets 145 to carry part 144 of the trough aforesaid. A gear pinion 148 mounted on spindle 150 is rotated by a gear segment 143 attached to arm 33. As member 33 moves the orientation of plate 138 is unchanged. Spindle 150 therefore rotates. The rotation retracts the trough part 144 to be clear of the conveyor as the honeycomb is lowered.

The other trough part and vacuum cups, associated with 34 & 35 are mounted by means which is a mirror-image of that shown in FIG. 8.

At the unloading station each packed unit (apples resting on a layer pad and filling the cells of the expanded honeycomb) is lifted clear of the conveyor by the mechanism shown in FIG. 12. Cam 105 (see also FIG. 11) raises and lowers arm 160 which causes frame 161, guided by radius rods 162 to rise and fall. At its upper face the frame carries an assembly of feet 163 which fit between the slats of the conveyor (while it is stationary) and come into contact with the layer pad and raise it, together with the apples and honeycomb. Referring to FIG. 6, the assembly moves up into a light confining frame 44 (see FIG. 13). Frame 44 has four lugs 166 which are attached to the moving members of linear ball races, not shown. Hinged flaps 164 on two opposite sides of the frame are moved into a vertical position, when the frame is moved to position it over a carton (46 in FIG. 6) by the engagement of lugs 165 with fixed taper cams. The frame 44 is moved to and fro by a sprocket 169 (FIG. 14) driven by an electric motor and a reduction gear box system (not shown) provided with electrically operated clutch and brake systems. A sprocket 169 drives a chain 171 which passes around an idler sprocket 170. A block 173, attached to the chain, carries a rod 172 which is pivotally attached at X to an outrigger bearing 168 secured to the top edge of frame 44.

Figure 15:
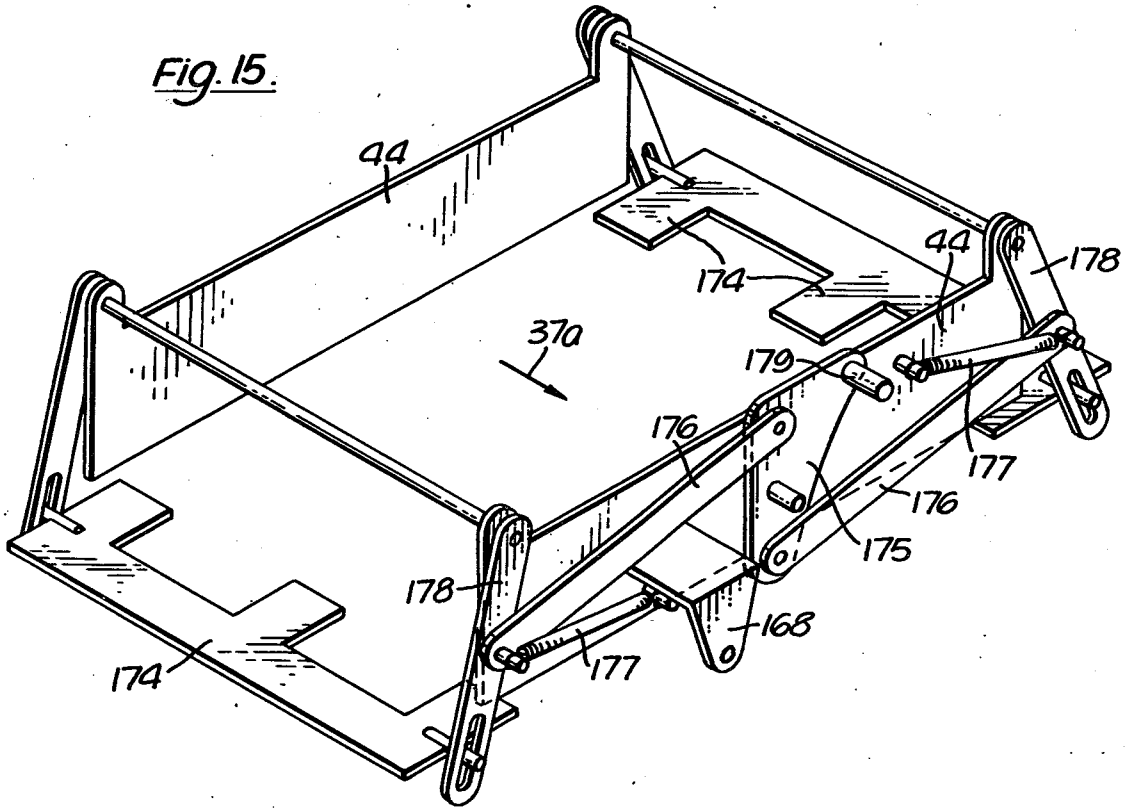

In FIG. 15 are shown sliding supports 174 which take over the support of the layer pad from the feet 163 when these feet are lowered. The sliding supports 174 are moved in and out by a lever 175 which acts through links 176 and 178. Return springs 177 bias the sliding supports 174 to the fully-in or fully-out positions from a neutral center position. A lug 179 strikes a fixed stop to slide the supports 174 outwardly to drop the load. Lug 179 is moved in the opposite direction when over the conveyor by a solenoid-actuated push rod (not shown).

Figure 16:
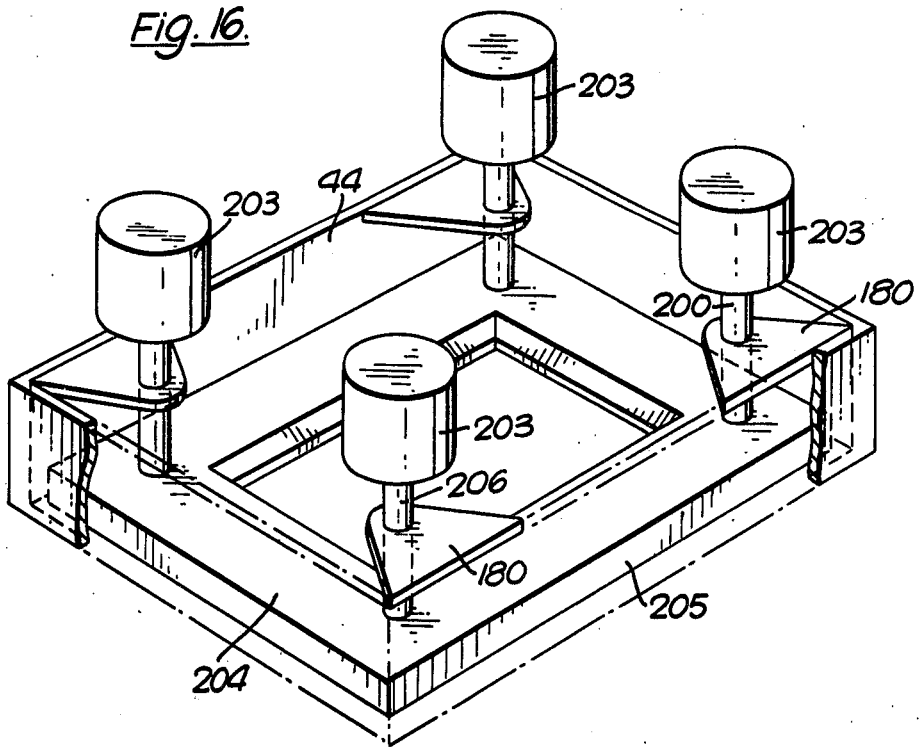

FIG. 16 shows a frame 204 with weights 203 which bears, by a foam rubber layer 205, on top of the honeycomb to help eject the load cleanly in a horizontal attitude. The guides 180 for stems 206 which mount the weights are carried on the travelling frame 44.

Figure 17:
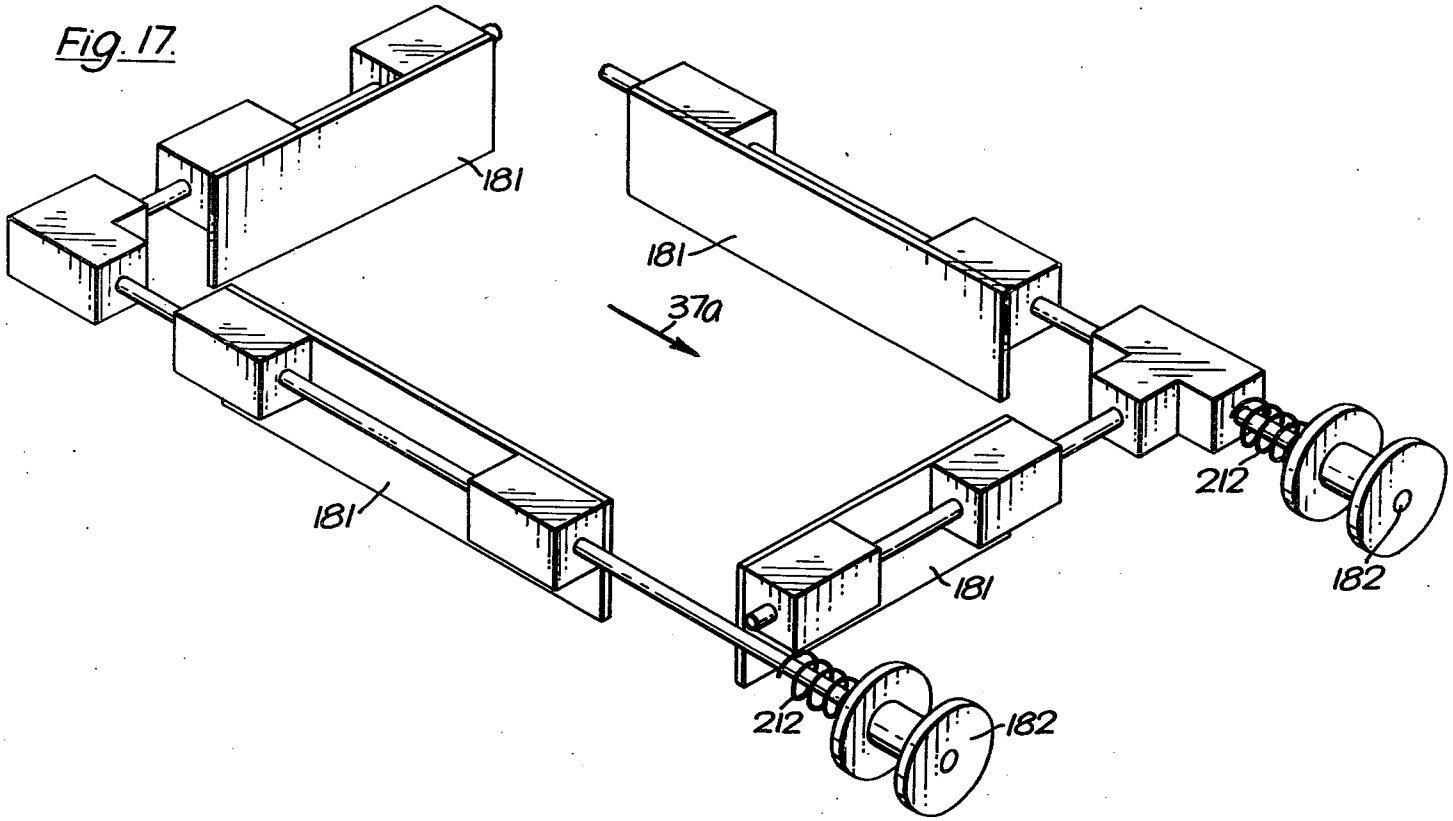
Figure 18:
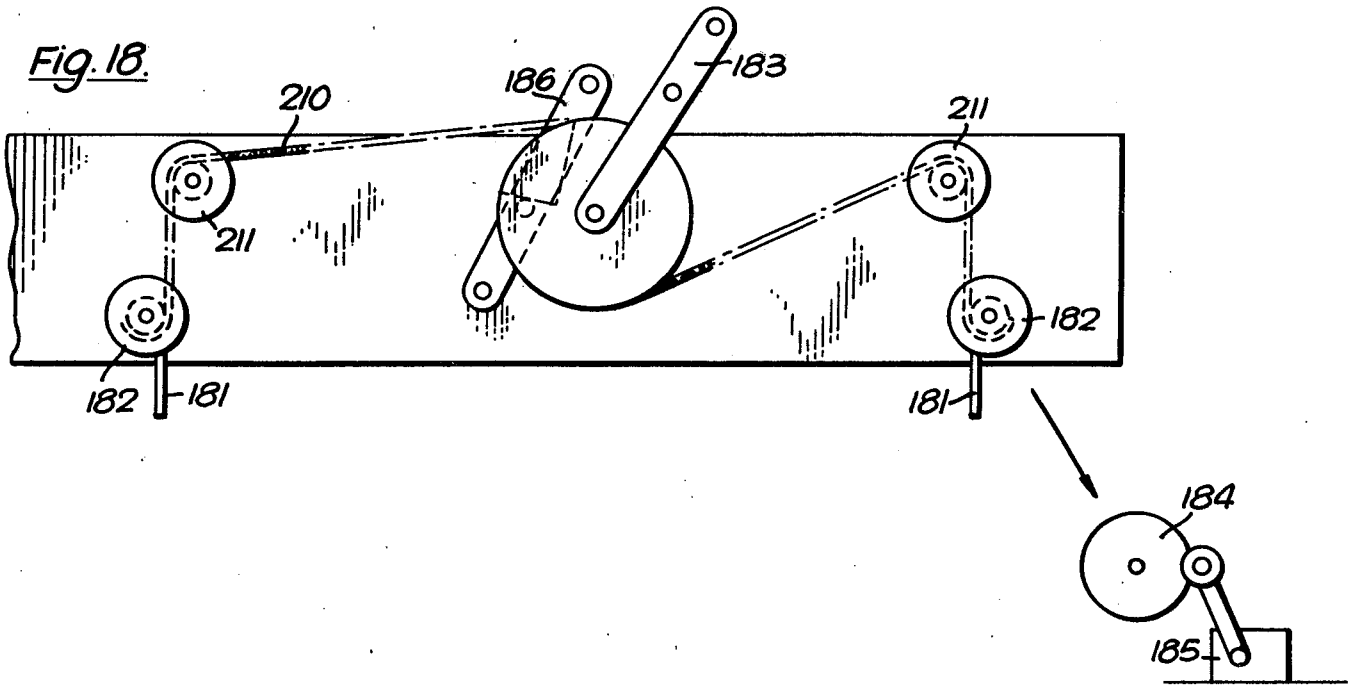

FIG. 17 shows a set of flaps 181 positioned to lie over the cartons to be loaded as part of a fixed assembly which runs transversely across the direction of the conveyor and includes the linear ball races, aforesaid. These flaps are raised when removing a filled carton and replacing it with an empty one. When the flaps 181 are lowered, their lower edges enter the top of the carton and assist the loads to enter the carton cleanly. The operating mechanism for flaps 181 is shown in FIG. 17. Pulleys 182 are rotated by operating handle 183 (FIG. 18) through chain 210 via idler pulleys 211. Torsion springs 212 bias the flaps into a down position. A safety cut-out cam 184 is provided so that the switch 185 cuts off the driving motor for the travelling carriage 44 unless the flaps are in the down position. A simple locking lever 186 is provided to hold the operating handle 186 in the flaps-raised position.

At many positions in the machine, safety electric interlocks are provided to prevent a movement taking place unless other associated components are correctly positioned.

It will be understood that the description of particular mechanisms is given in the foregoing for purposes of illustration only, and that various departures from the form of such mechanisms can be made by those skilled in the art, once the essential features have been understood without departing from the scope of the invention.

I claim:

1. An apparatus for packaging articles of generally spherical fruit by arranging said articles in slices of structural honeycomb material having an expansion direction and which, when they are expanded in said expansion direction, adopt an open cellular state providing a set of principal rows of complete cells extending in the expansion direction and also a pair of rows of boundary cells positioned one on each side of the set of principal rows and also extending in said expansion direction, the boundary cells being incomplete cells which open in directions facing outwardly away from the principal rows and the cells of the principal rows and said pair of rows being so positioned along their rows that the cells of each row which extends in the expansion direction between a pair of other rows which extend in the expansion direction are positioned to alternate with the cells of said other rows and project between them across said expansion direction, said apparatus comprising a travelling conveyor for conveying the slices in said expansion direction in turn along a path extending through a first loading station and then through a second loading station, holding means on the conveyor for holding the slices in said open cellular state while they are being so conveyed, a first rotary feeder at the first loading station, a second rotary feeder at the second loading station, each of said feeders being generally cylindrical and being mounted for rotation about a rotational axis positioned above the conveyor and extending transversely to the said path, and each of said feeders being formed (a) to provide sets of radially outwardly directed article locating formations each of which formations is configured to locate a single article of the fruit circumferentially on its feeder, each said set extending circumferentially part way only around its feeder from a first article locating position to a final article locating position and leaving a circumferential part of the feeder free from article locating formations between the final article position and the first article position and (b) to provide side walls bounding the sets of article locating formations to prevent the sideways displacement of article from said sets, the sets of formations on the feeders being so positioned in the axial directions of the feeders that the sets on the first feeder correspond in their positions with alternate rows of the cells and the sets on the second feeder correspond with the remaining rows of the cells, and the article locating formations on each feeder being so positioned within their sets as to be opposite one another in the axial direction of their feeder, chutes for delivering the articles to the feeders for engagement within the article locating formations, driving means for rotating the feeders so that the engaged articles are carried by rotation of the feeders downwardly towards the slices held by the holding means in the open cellular state, retaining means for retaining the engaged articles within the locating formations while they are being carried downwardly and releasing them from their respective feeders substantially at the lowermost positions of their rotational loci, said driving means being so synchronized with the travel of the conveyor that as a slice of honeycomb material held on the conveyor in said open cellular state by said holding means begins to be conveyed beneath said lowermost positions, the release of the articles by the retaining devices begins and the articles are delivered one by one to the cells of the rows, the articles for said alternate rows of cells being delivered from the first rotary feeder and the articles for said remaining rows of cells being delivered from the second rotary feeder, and a pair of driven belts having laps travelling with the conveyor and disposed to retain, in the incomplete boundary cells, the articles delivered thereto.

2. An apparatus according to claim 1 in which the chutes are so disposed relative to the feeders that the articles are, after engagement within the article locating formations, carried upwardly by the rotation of the feeders before being carried downwardly.

3. An apparatus according to claim 1 having a separate chute for each set of article locating formations.

4. A method of packaging articles of generally spherical fruit by arranging said articles in slices of structural honeycomb material having an expansion direction and which, when they are expanded in said expansion direction, adopt an open cellular state providing a set of principal rows of complete cells extending in the expansion direction and also a pair of rows of boundary cells positioned one on each side of the set of principal rows and also extending in said expansion direction, the boundary cells being incomplete cells which open in directions facing outwardly away from the principal rows and the cells of the principal rows and said pair of rows being so positioned along their rows that the cells of each row which extends in the expansion direction between a pair of other rows which extend in the expansion direction are positioned to alternate with the cells of said other rows and project between them across said expansion direction, said method comprising conveying the slices in said expansion direction, in turn through a first loading station and then through a second loading station while holding the slices in said open cellular state and confining the slices between travelling closure members which face inwardly towards the complete cells and close the incomplete cells, feeding a plurality of streams of the articles to each loading station, the streams fed to the first loading station corresponding in position and number with alternate ones of the rows extending in the expansion direction of the slices, and the streams fed to the second loading station corresponding in position and number with the remainder of the rows, lifting from each of the streams being fed to the first loading station a number of articles equal to the number of cells in said alternate rows, lifting from each of the streams being fed to the second loading station a number of articles equal to the number of cells in the said remainder of the rows, said articles being lifted from their streams in succession with the lifting at a loading station at the same moment, and being continued at the same rate, for each stream, conveying the lifted articles around paths extending first upwardly and then downwardly to a level immediately above the slices, releasing the articles from their paths for reception in the cells in said alternate rows at the first loading station, and for reception in the rows between said alternate rows at the second loading station, so that the articles fall into the cells of each row in succession.

* * * * *